US008701239B2

(12) United States Patent
Bauernfeind et al.

(10) Patent No.: US 8,701,239 B2
(45) Date of Patent: Apr. 22, 2014

(54) ORAL CARE DEVICE

(75) Inventors: Siegfried Bauernfeind, Frankfurt am Main (DE); Andreas Birk, Kronberg/Taunus (DE)

(73) Assignee: Braun GmbH, Kronberg (DE)

( * ) Notice: Subject to any disclaimer, the term of this patent is extended or adjusted under 35 U.S.C. 154(b) by 181 days.

(21) Appl. No.: 13/233,760

(22) Filed: Sep. 15, 2011

(65) Prior Publication Data

US 2012/0030891 A1 Feb. 9, 2012

Related U.S. Application Data

(63) Continuation-in-part of application No. PCT/IB2010/051120, filed on Mar. 15, 2010.

(51) Int. Cl.
*A46B 9/04* (2006.01)

(52) U.S. Cl.
USPC ..... 15/167.1; 15/110

(58) Field of Classification Search
USPC ..... 15/167.1, 22.1, 110, 207.2, 172
See application file for complete search history.

(56) References Cited

U.S. PATENT DOCUMENTS

| | | | | |
|---|---|---|---|---|
| 2,273,278 | A * | 2/1942 | MacKenzie-Kennedy | 15/167.1 |
| 4,679,273 | A * | 7/1987 | Okin | 15/167.1 |
| 4,729,142 | A * | 3/1988 | Yoshioka | 15/167.1 |
| 4,776,054 | A | 10/1988 | Rauch | |
| 5,052,071 | A | 10/1991 | Halm | |
| 5,465,450 | A | 11/1995 | Humphries | |
| 5,774,923 | A | 7/1998 | Halm | |
| 6,073,299 | A | 6/2000 | Hohlbein | |
| 6,178,582 | B1 | 1/2001 | Halm | |
| 6,314,605 | B1 * | 11/2001 | Solanki et al. | 15/167.1 |
| 6,564,416 | B1 | 5/2003 | Claire et al. | |
| 8,151,397 | B2 * | 4/2012 | Moskovich et al. | 15/201 |
| 2008/0184511 | A1 | 8/2008 | Brown et al. | |
| 2009/0070947 | A1 | 3/2009 | Baertschi et al. | |

FOREIGN PATENT DOCUMENTS

| | | |
|---|---|---|
| FR | 2548528 | 1/1985 |

OTHER PUBLICATIONS

International Search Report, mail date Jul. 28, 2010, 10 pages.

* cited by examiner

*Primary Examiner* — Shay Karls
(74) *Attorney, Agent, or Firm* — Vladimir Vitenberg; George Henry Leal

(57) ABSTRACT

A toothbrush head with a bristle support to which a plurality of tuft-shaped cleaning elements are affixed is described. The bristle support including at least one movable rocker having a first end attached to it on the side remote from a handpiece and having a free second end which is on the side close to the handpiece. Said rocker carrying at least one row of cleaning elements. At least the cleaning elements arranged on the rocker furthest from a longitudinal center plane of the toothbrush head have their free ends inwardly tilted towards said longitudinal center plane at an acute angle.

17 Claims, 3 Drawing Sheets

(Schnitt A-A)

ORAL CARE DEVICE

CROSS REFERENCE TO RELATED APPLICATION

This application is a continuation-in-part application of prior copending International Application No. PCT/IB2010/051120, filed Mar. 15, 2010, designating the United States, which is incorporated herein by reference in its entirety.

FIELD OF THE INVENTION

The present invention pertains to a personal hygiene device, more particularly to a toothbrush.

BACKGROUND OF THE INVENTION

With toothbrushes it is desirable for the bristle cluster to be elastically mounted relative to the edge part with which the toothbrush is guided. In this regard the toothbrush head and the bristle cluster can adapt themselves to the contour of the row of teeth or gingiva being cleaned, and errors in the angle of application may be automatically compensated for and excessive contact pressures can be reduced by yielding. For this purpose it is known for the bristle support carrying the bristle tufts to be elastically mounted. For example, some conventional toothbrush heads include bristle supports which are configured to be elastic in some regions so that different sections of the bristle support can move relative to each other.

This movement may be accomplished by incorporating flexible sections of elastomer in a conventional plate-shaped bristle support so that parts of the bristle cluster separated from the handpiece or the toothbrush neck by such an elastomer section can flex away under the applied cleaning pressure. In general, this can cause a part of the bristle cluster furthest from the toothbrush neck or handpiece to flex away, which in turn can result in difficulty cleaning teeth at the hard-to-reach areas of the oral cavity because the section of the bristle cluster penetrating deepest into the oral cavity always flexes away.

It is therefore desirable to provide an improved toothbrush head and an improved toothbrush of which prevents the disadvantages of the conventional toothbrushes while maintaining a pleasant mouth feel for consumers.

SUMMARY OF THE INVENTION

Proposed therefore is a toothbrush head with a different elasticity or movability, on which the sections of the bristle cluster at the brush head tip, i.e., those sections most distant from the toothbrush neck or handpiece, are mounted for least compliance, while those sections of the bristle cluster arranged closer to the handpiece neck are allowed to comply or flex away more intensively. For this purpose, provision is made on the toothbrush head for a rocker which protrudes rearwardly, i.e., it is attached to the toothbrush head with its end remote from the toothbrush neck while projecting towards the toothbrush neck with its free end. While this free end close to the toothbrush neck is allowed to rock, move, flex, up and down, enabling the bristle tufts or cleaning or massage elements affixed thereto to resiliently spring away under the applied cleaning pressure, the bristle tufts or cleaning or massage elements arranged at the tip of the brush head are mounted without such a rocking, moving, flexing, effect so that they are unable to yield in like manner.

Such a toothbrush head with rearwardly protruding rockers is disclosed, for example, in U.S. Patent Application No. 2008/0184511 A1. In some embodiments, two rockers are provided which form the legs of a U and are joined together by a common middle section by means of which said rockers are attached to the body of the toothbrush head. The free ends of the rockers extend towards the toothbrush neck part so that the bristle tufts mounted thereon are able to rock up and down. In this arrangement, the two rockers are spaced apart from each other and extend to the right and left of a bristle support central section which is rigidly connected to the body of the toothbrush head so that the lateral sections of the bristle cluster formed by the rockers are able to rock up and down relative to the bristle support central section.

For such embodiments however, the width of the bristle support in a direction transverse to the toothbrush longitudinal direction can increase because said rockers require a certain distance from the central region of the bristle support in order to ensure the desired movability while permitting the bristle tufts to be fastened. This can impair the desired population density of the bristle clusters on the whole and the desired compactness for facilitating penetration into inaccessible areas.

Preferably, high flexibility and adaptability of the bristle cluster to different contours should be accompanied by improved control over the cleaning movement for easier cleaning of difficult-to-reach areas.

DETAILED DESCRIPTION OF THE INVENTION

Figure 1:
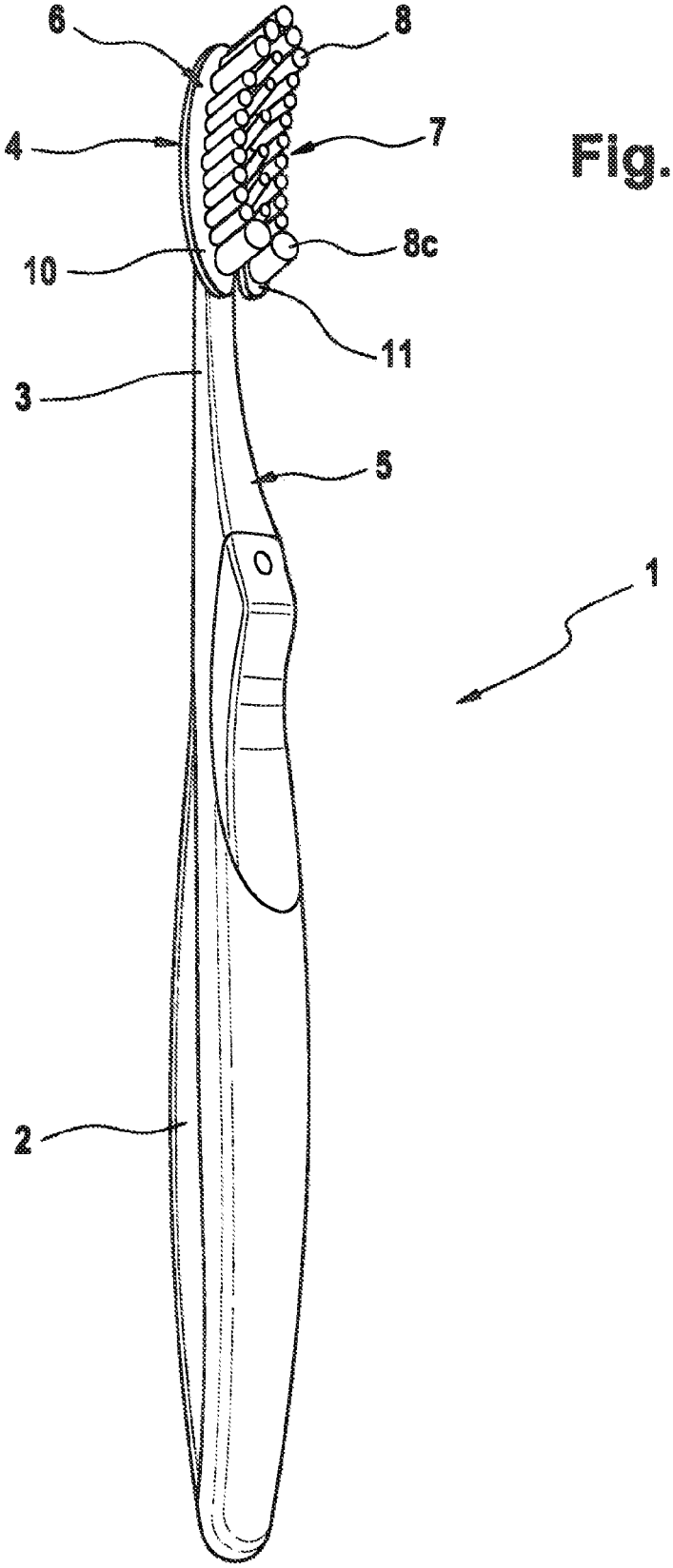
FIG. 1 is a schematic perspective view of a toothbrush having a bristle support including two rockers according to an advantageous embodiment of the invention.

Definitions:

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

In this context the term "bristle support" does not mean necessarily that the support actually carries "real" bristles or tufts of bristles but also includes the possibility of other cleaning elements, for example, in the form of elastomer strips or interproximal tips or other massage elements being affixed to the bristle support instead of or in addition to bristle tufts.

Description:

To obtain a compact and densely packed cluster of bristles or of cleaning and/or massage elements in spite of a movable rocker or wing arrangement it is proposed arranging the cleaning elements in the edge regions or outer lying sections of the rocker at an inclination towards the center of the bristle support or toothbrush head. In this configuration, the working surface area of the cluster of bristles or cleaning elements, defined by the free ends of the cleaning elements, is smaller than the base area of the bristle support within which said cleaning elements are affixed to the bristle support with their lower ends. This results in not only a smaller appearance of the brush head but also better control of the cleaning movement because a smaller, more compact working surface area stands in direct contact with the teeth or gingiva, i.e., more bristles or cleaning elements are active where the user wants them to be active. According to the invention, at least the cleaning elements arranged on the rocker furthest from a longitudinal center plane of the toothbrush head have their free ends inwardly tilted towards said longitudinal center plane at an acute angle. Said longitudinal center plane is understood to be a plane containing the toothbrush longitudinal axis and extending parallel to the main direction of the bristle tufts or cleaning elements. Even with a wide bristle support, the inwardly inclined free ends of the outermost bristle tufts or cleaning elements can provide a compact bristle cluster. Additionally, even with the movability of the rocker, the cluster of bristles or cleaning elements is able to hold application substances such as dentifrice efficiently on the working surface and prevent the dentifrice from easily wandering into spaces on the bottom of the bristle support.

The inwardly inclined arrangement of the rocker's outer tufts is an advantage in particular when the bristle support includes a movable pair of rockers which are arranged on the right and left essentially symmetrically relative to the longitudinal center plane of the toothbrush and/or form outer edge sections of the bristle support. In this arrangement, at least the cleaning elements or bristle tufts arranged furthest from the longitudinal center plane have their free ends tilted inwardly towards the longitudinal center plane, resulting in a reduced width of the working surface defined by the free ends. The cleaning elements of the left and right rocker are therefore inclined in opposite directions towards each other.

In some embodiments, provision can be generally made for all the cleaning elements on the movable rockers to be tilted inwardly at like angles, including however also the possibility for only some of the cleaning elements on the rockers to be inclined. Alternatively to such a uniform inclination of the cleaning elements it is also possible to provide for various cleaning elements on a rocker to be variously steeply inclined at different angles of tilt. Advantageously, cleaning elements arranged further to the outside, i.e., further from the longitudinal center plane, may be more steeply inclined inwardly than cleaning elements arranged further to the inside on the rocker.

The inclination of the cleaning elements on the rockers can be generally effected at variously large angles. In order to obtain the desired smaller working surface and the desired compactness of the cluster of working elements without having to suffer from the disadvantage that the cleaning elements yield excessively due to too great an inclination, the angle of inclination can be monitored. The angle of inclination can be any suitable angle. Some examples of suitable angles for the inclined cleaning elements are between about 1 degree to about 30 degrees, between about 5 degrees to about 20 degrees, or any suitable number or range including or within these values.

The angles are approximate, relative to the longitudinal center plane. In this arrangement, it has proven to be an advantage for the outermost cleaning elements, i.e., those arranged furthest from the longitudinal center plane, to be tilted with their longitudinal axes at an angle of about 10 degrees to about 20 degrees relative to the longitudinal center plane, while cleaning elements further inside, i.e., those spaced a smaller distance from the longitudinal center plane, are inclined on the rockers at an angle of between about 5 degrees to about 15 degrees relative to the longitudinal center plane.

In an arrangement including two rockers or wings having cleaning elements arranged on them it is possible to provide between the two rockers a central bristle support section which advantageously is rigidly connected to a body of the toothbrush head so that during the up and down rocking movement the rockers are moved relative to the central bristle support section. On said central bristle support section it is likewise possible to affix cleaning elements, in particular bristle tufts and/or elastomer strips, and said central cleaning elements can be arranged advantageously without being tilted, i.e., parallel to the longitudinal center plane. However, the cleaning elements affixed to the central bristle support section can be tilted in said longitudinal center plane, i.e., forwardly or rearwardly in the toothbrush longitudinal direction, preferably at an acute angle relative to a perpendicular drawn upon the toothbrush longitudinal axis. In an alternative embodiment of the invention, it is also possible however to dispense with such a central bristle support section, i.e., another bristle support section is omitted between the rockers arranged on the right and the left and/or said rockers adjoin each other directly.

The cleaning elements arranged on the rockers have, with regard to the point of attachment or fulcrum of the rocker, a different lever arm depending on the distance from the free end of the rocker, i.e., a cleaning element converts the applied cleaning pressure more or less easily into a deflection movement of the rocker depending on where said cleaning element is arranged on the rocker. To make use of this effect and obtain better control of the deflection movement of the rocker, in some embodiments, a cleaning element is provided towards the free end of the rocker which is more solid and in particular more resistant to kinking. For example, the last cleaning element at the free end of a rocker may be configured to be more solid and in particular more resistant to kinking than the cleaning elements arranged in a central section of the rocker and/or further towards the first end (fixed end) of the rocker, with said more solid bristle tuft or cleaning element being advantageously at least as high as the cleaning elements arranged further towards the first end. The force which acts to move the flexible rockers during cleaning is introduced in a more directionalized way by the last larger cleaning element or elements, as a result of which the deflection movement of the rocker is controlled more precisely. Small, thin bristle tufts would tend to bend away in an uncontrolled manner. On the other hand it is possible, depending on the angle at which the user holds the brush, to exert considerable pressure on the last cleaning elements arranged at the free ends of the rocker. By providing the last cleaning element or elements with greater solidity and/or better resistance to kinking and/or larger cross section, the cleaning element is prevented from twisting or yielding and distributes the acting force over a larger area. This results in a more agreeable cleaning experience and reduces pricking on the gingiva.

Advantageously, said cleaning elements on the free end of the rockers may be higher than the adjoining cleaning elements and/or the cleaning elements arranged in a central section of the rockers so that the first flexion of the rockers or introduction of force at the beginning of the flexion is adopted in controlled manner. Not until the rocker performs a certain deflection movement do the adjoining cleaning elements and/or the bristle tufts arranged in a central section of the rocker come into play and distribute the load uniformly for an optimum cleaning experience without local overloading.

In order on the one hand to enable sufficient adaptation to different contours through yielding of the rockers but on the other hand to enable cleaning forces sufficiently high for penetration into interproximal spaces, it is desirable for the rockers to yield in a predesigned manner under a defined cleaning force and to obtain a controlled response of the rockers to cleaning pressure. In this regard it has proven to be particularly advantageous for the rockers to be configured such that, given an applied force in the range of about 1 N to about 5 N, approximately, with which the toothbrush head acts against the teeth and/or gingiva, the free ends of the rockers perform a deflection movement of a minimum of about 1 mm and a maximum of about 6 mm, preferably in the range of about 2 mm to about 3.5 mm, or any number or range including or within these values (this applies to the deflection movement of the rockers alone—the head end is assumed to be in fixed position). This achieves a good compromise between light-footed adaptation to different elevations in the contour on the one hand and good controllability of the cleaning movement on the other hand.

The desired compliance of the rockers can be generally achieved in a variety of ways. For example, the rockers can be movably mounted while at the same time being supported as by an elastic spring element. However, in some embodiments, the rockers have their first ends non-rotatably attached to a body part of the toothbrush head and for themselves are configured for elastic deformation, such that the previously mentioned actuating, flexing, or deflecting movement of the rockers is obtained by applying the customary forces during cleaning. In other words, the rockers are elastically constructed such that the desired deformation of the rockers occurs under normal cleaning pressures.

In order to obtain the desired compliance with rocker dimensions which are easy to manufacture but on the other hand compact, in some embodiments, the rockers may comprise a free length in the range of about 20 mm to about 70 mm, approximately, about 30 to about 50 mm, approximately, or any number or range within or including these values. Additionally, the rockers may comprise or, in some embodiments, may consist of, a material having a modulus of elasticity in the range of about 300 to about 700 MPa, between about 350 to about 500 MPa, or any number or range including or within these values. In some embodiments, the rockers may be comprised of a mixture of polyethylene and polypropylene, in which advantageously TPE amounts of between about 10% to about 30%, greater than about 20%, and PP to between about 70% to about 90%, greater than 80%, or any number or range including or within the values provided. In some embodiments, the rockers may comprise a mixture of various polypropylene grades.

The rockers can be generally manufactured from the same material as the body of the toothbrush head and/or the neck part of the toothbrush. For example, the rockers can be integrally injection-molded directly onto the body of the toothbrush head as a one-piece construction.

Alternatively, the rockers can also be comprised of a different material than the body of the toothbrush head and/or the neck part. This enables not only visual differentiation and hence functional highlighting but also the component properties to be matched to the respective function optimally.

Said rockers can be generally connected in a variety of ways to the body of the toothbrush head. For example, the rockers can be joined by positive engagement, for example by snap action, or by bonding materials to each other as by welding or molding on, or also by frictional engagement as by adhesion. Subsequent connection enables the pertinent components to be manufactured separately.

To obtain a connection which is particularly strong and secure against inadvertent disconnection, said connection can be provided where the rockers are securely attached to the body part of the toothbrush head by means of a connection established by positive engagement and material bonding. For example, said body part of the toothbrush head can have a fastening section formed as an undercut and equipped preferably with opposing notched undercuts onto which the rockers are injection-molded so that the rocker material engages into said notches. In some embodiments, the body part may comprise a recess for accommodating a center bristle support section of the head. The central bristle support section may be injection molded into the body part or vice versa. Additionally, the rockers may be integrally formed with the central bristle support.

The resilient springing away of the rockers under the customary cleaning pressures applied changes the angle of inclination of the rocker, as a result of which the angle of application of the working surface section, which is formed by the free ends of the cleaning elements affixed to the rockers, also changes. As this is desired to a limited degree only, in some embodiments, the toothbrush head and/or the neck part formed thereon in may be configured to move elastically in the opposite direction. In particular a neck part connectable to the bristle support can be configured to be elastically movable under cleaning forces in the range of about 1 N to about 5 N on the toothbrush head. For this purpose, said neck part can have, at a distance from the bristle support and/or at a distance from the rockers, a reduced cross-section preferably in the form of a window-like opening. In particular said opening through the neck part can be provided in a vertical direction, i.e., parallel to the longitudinal center plane. Through a resilient springing-back motion of the rockers on the one hand and the neck part on the other hand it is possible to compensate for the change in the angle of application caused by the resilient springing-back motion of the rockers. At the same time the different leverage ratios cause the deflection movements to occur in multiple stages. While the rockers effect a fine adaptation, a resilient springing-away movement of the entire toothbrush head through deformation of the neck part enables a coarser adaptation movement to be achieved.

These and further features which, when used singularly or in any combination and irrespective of their summary in the claims, may form the subject-matter of the present invention will become apparent not only from the claims and the preceding description but also from the accompanying drawings and the subsequent description of preferred embodiments.

The toothbrush illustrated in FIG. 1 is a manual toothbrush 1 absent a drive mechanism, including a handpiece 2 preferably injection-molded from plastics, which forms a grip of the toothbrush 1 and is of an essentially elongated, approximately rod-shaped configuration.

Said handpiece 2 is connected by way of a neck part 3 to a toothbrush head 4 which can be integrally molded on the handpiece 2 and/or the neck part 3 as a one-piece construction. Alternatively, said toothbrush head 4 can also be detachably connected to the neck part 3. Said toothbrush head 4 comprises in the illustrated embodiment a body part 5 which is securely connected to the neck part 3 and on whose upper side a bristle support 6 is arranged.

The bristle support 6 carries a bristle cluster 7 comprising a plurality of bristle tufts 8 which form, where applicable with additionally arranged elastomer strips, the cleaning elements of the toothbrush 1.

Figure 5:
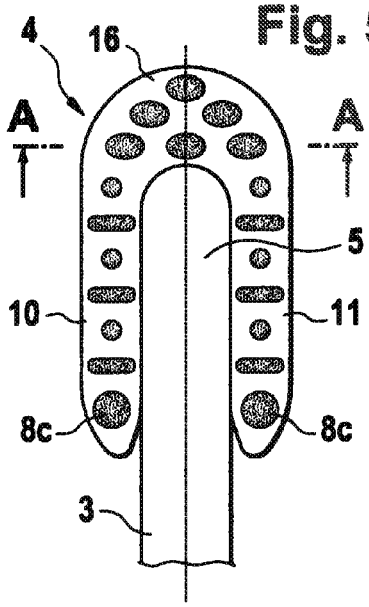
FIG. 5 is a top plan view of the toothbrush head of FIG. 4 showing the arrangement of the bristle tufts and their configuration on the rockers.

Said bristle support 6 may be formed of a plurality of pieces, comprising, for example, two laterally arranged rockers 10, 11 extending generally parallel to the toothbrush longitudinal direction 9. Said rockers 10 and 11 may enclose between them a central, elongated bristle support section 12 (shown in FIG. 3) which may be rigidly connected to said body part 5 of the toothbrush head 4, and it will be understood, of course, that the rigid connection may be configured to be detachable in order to be able to replace this part of the bristle support 6 as well. Alternatively, as shown in FIG. 5, the lateral rockers 10 and 11 may have no bristle support section in between so that no further bristle tufts are provided between the bristle tufts 8 positioned on the rockers 10 and 11.

Said rockers 10 and 11 are attached with their first front ends 13, which lie at the tip of the toothbrush head 4 and/or on the side remote from the neck part 3, to the body part 5 of the toothbrush head 4, while the freely protruding other ends 14 of the rockers 10 and 11 point towards the neck part 3 and/or extend up to the end of the toothbrush head 4 on the side close to the neck part. Accordingly, the rockers 10 and 11 are elongated and generally beam-shaped or wing-shaped configuration and protrude freely from the front end of the toothbrush head 4 rearwards to the handpiece 2, thereby enabling said free ends 14 to rock, move, flex, freely up and down at the end of the toothbrush head 4 close to the handpiece 2. In this arrangement, said rockers 10 and 11 are configured for movement such that said rockers 10 and 11 are able to rock, move, flex, up and down. For example, the rockers 10, 11 are able to flex generally parallel to a longitudinal center plane 15 (shown in FIG. 2) and/or for example with the longitudinal center plane 15 corresponding to the plane of projection.

In the embodiment shown in FIGS. 2 and 3 and FIGS. 4 and 5, the two rockers 10 and 11 are interconnected at their first, attached ends 13 by a connecting and/or mounting section 16, so that said rockers 10 and 11, in combination with the connecting and/or mounting section 16, form a U-shaped structure.

At said mounting section 16 the rockers 10 and 11 are fastened to the body part 5. The connection to the body part 5 can be generally configured in a variety of ways, as initially explained. In the embodiment shown in FIG. 6, the connection can be advantageously established by positive engagement and by frictional engagement or material bonding. In particular the body part 5 of the toothbrush head 4 may comprise an undercut fastening section 17 embedded into the injection-molded material of the rockers 10 and 11 or the mounting section 16. In the embodiment shown in FIG. 6, the fastening section 17 of the body part 5 may comprise a flange section which protrudes to the upper side of the toothbrush head 4 or to the bristle support 6 and has opposing groove-shaped constrictions or undercuts 18 that can be worked into the body part 5 in the manner of a longitudinal groove.

Figure 6:
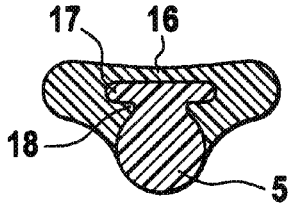
FIG. 6 is a sectional view taken along the line A-A of FIG. 5 showing the connection between the rockers of the bristle support and the body of the toothbrush head.

In the embodiment shown in FIG. 6, the mounting section 16 of the rockers 10 and 11 may be molded on said fastening section 17 of the body part 5 by the two-component injection molding process so that a connection is obtained by positive engagement and by material bonding or frictional engagement. This can reliably prevent unintentional disconnection of the rockers 10 and 11 and/or the mounting section 16, on the other hand the rockers 10 and 11 can be formed from the best possible material for the elasticity of the rockers 10 and 11, independently of the material of the neck part 3 and/or the body part 5.

The geometry of the rockers 10 and 11 may generally vary and be adapted to the desired properties of the bristle cluster sections. In the illustrated embodiments, the rockers 10 and 11 have a free length L - that is, the length protruding from the mounting section 16 of from about 30 mm to about 50 mm, approximately. Advantageously, the cross section and the material for the rockers 10 and 11 are selected such that the rockers 10 and 11 experience a vertical deflection x of from about 2 mm to about 3.5 mm, approximately, at their free ends 14 under normal cleaning forces. According to one embodiment of the invention, this can be achieved in that the rockers 10 and 11 have in the region of their free length L an approximately unchanging cross section and a modulus of elasticity in the range from about 350 to 500 MPa so that bending of the rockers is obtained. Said deflection x can occur under customary cleaning forces acting on the toothbrush head 4 in the range of about 1 to about 5 N, approximately, and in particular from about 3 N, approximately, said cleaning force a portion of which may be symbolized in FIG. 7 by the arrow 19. Furthermore, said deflection x is related to a sole deformation of the rockers 10 and 11—the free head end being fixed.

Figure 2:
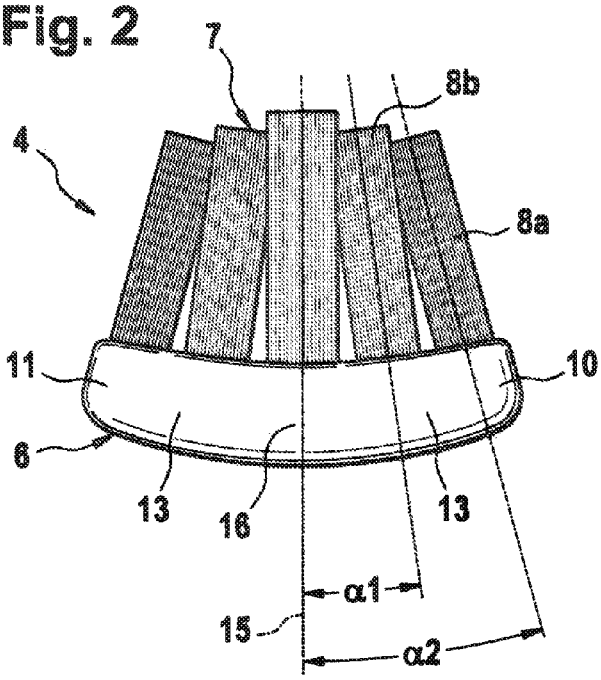
FIG. 2 is a schematic end view of the toothbrush head of the toothbrush of FIG. 1 showing an obliquely inwardly inclined arrangement of the bristle tufts positioned on the rockers.
Figure 3:
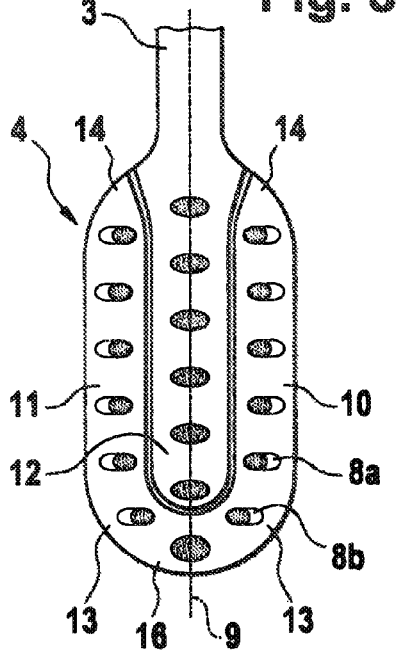
FIG. 3 is a top plan view of the brush head of FIG. 2 showing the extension of the lateral rockers and the arrangement of the bristle tufts affixed thereto.
Figure 4:
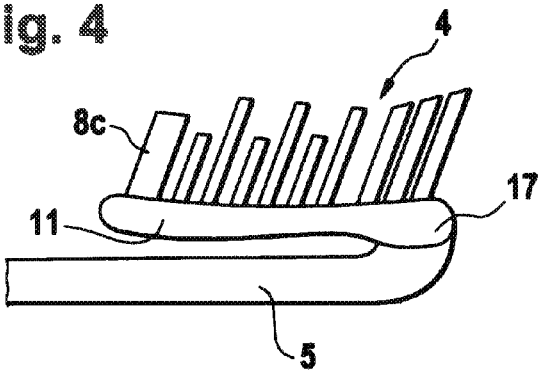
FIG. 4 is a side view of a toothbrush head having two lateral rockers similar to the preceding Figures, but with different bristles being provided on the rockers and no further bristle support part and no further bristle tufts being provided between the rockers.
Figure 7:
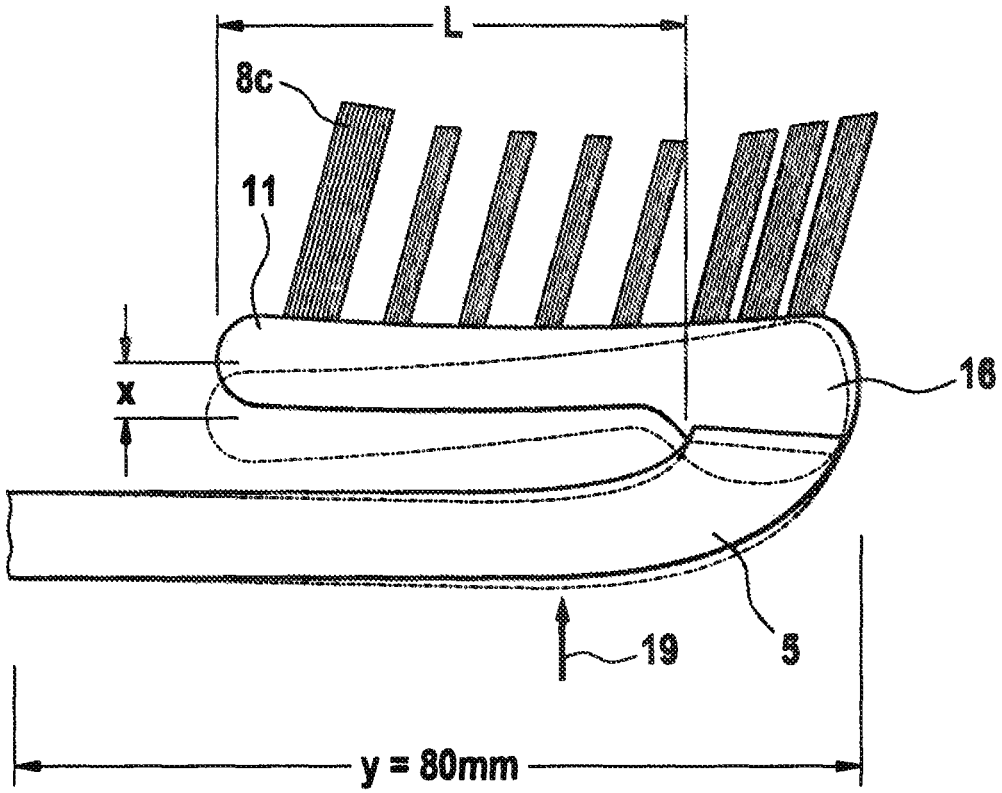
FIG. 7 is a schematic side view of a toothbrush head with lateral rockers of the bristle support similar to the preceding embodiments to illustrate the movability of the lateral rockers of the bristle support.

As the embodiment of FIGS. 2 and 3 shows, tufting of the rockers 10 and 11 may advantageously comprise an inclined arrangement of the bristle tufts 8 according to which the bristle tufts 8 are tilted at an acute angle relative to the longitudinal center plane 15. In particular said bristle tufts 8 on the rockers 10 and 11 may be inwardly tilted towards the center of the bristle cluster 7 so that the working surface of the bristle cluster 7, which is defined by the free ends of the bristle tufts 8, is smaller than the area at the foot of the bristle tufts, which is described by the envelope curve around the tufts on the bristle support. Such an inclined, or tilted configuration of the bristle tufts 8 will cause them to move sideways in a direction not parallel to their longitudinal axes during the use of the toothbrush, when at least one of the rockers 10, 11 moves up and down relative to the handpiece (FIG. 7).

As FIG. 2 shows, the bristle tufts 8 on the rockers 10 and 11 may be inwardly tilted at different angles, with bristle tufts 8*a* positioned further on the outside advantageously being more steeply inwardly tilted than bristle tufts 8*b* positioned further on the inside, i.e., closer to the longitudinal center plane 15. Bristle tufts lying directly on the longitudinal center plane 15 may be advantageously not tilted relative to said longitudinal center plane 15. As FIG. 2 shows, the outermost bristle tufts 8*a* may be tilted at an angle $\alpha 2$ of about 15°, approximately, while bristle tufts 8*b* lying further on the inside but still at a distance from the longitudinal center plane 15 may be tilted at an angle $\alpha 1$ of about 10°, approximately.

Because in use the free ends 14 of the rockers 10, 11 rock or flex away more intensely under the applied cleaning pressure than the rest of the rockers, the bristle tufts 8*c* (FIG. 7) located on the free ends 14 of the rockers 10, 11 are also deflected away more intensely than the rest of the bristle tufts, i.e., the bristle tufts 8*c*, affixed to the free end of the rocker are displaced farther than the bristle tufts positioned between the first end and the free end of the rocker. As the embodiment of FIGS. 4 and 5 as well as the embodiment of FIG. 1 show, the free end 14 of the rockers 10 and 11 may be provided with an enlarged and/or more solidly constructed bristle tuft 8*c* compared to the bristle tufts 8 positioned in the neighborhood and/or in a central region of the rockers 10 and 11 and/or further towards the point of attachment of the rockers. The bristle tuft 8*c* may have a larger cross section and/or a greater height and/or a greater resistance to kinking so that said bristle tuft 8*c* arranged on the free end 14 forms, for example, a control tuft that controls the rocking movement of the rockers 10 and 11. For example, a ratio of the area of cross section of said bristle tuft 8*c* on the free end 14 of the rockers 10 and 11 compared to the average area of cross section of the other bristle tufts 8 on the rockers 10 and 11, may be about 4/3 to about 6/3. The height of bristle tuft 8*c* may range from about 110% to about 150%, from about 120% to about 140%, or any number or range including or within these values, of the neighboring bristle tufts 8. As a result, said bristle tufts 8*c* on the free ends 14 urge the rockers 10 and 11 downwardly on contact with the teeth or gingiva, whereby the resulting pressure is better distributed over the larger area and the following bristle tufts do not engage until after an initial pressing down of the rockers 10 and 11, thus resulting in an on the whole agreeable cleaning experience.

In the embodiment shown in FIG. 5, the bristle tufts 8 on the rockers 10 and 11 may have advantageously different cross-sectional shapes, with bristle tufts with round cross sections alternating with bristle tufts with elongated, flattened cross sections in the illustrated embodiment, the latter being oriented in a direction transverse to the longitudinal direction of the rockers.

As FIG. 7 shows, the rockers 10 and 11 in the non-deflected initial position can be arranged approximately parallel to the longitudinal axis and/or parallel to a transversal plane containing the longitudinal axis which is perpendicular to the plane of projection of FIG. 7. In the depressed position, which is drawn with a dashed line in FIG. 7, the rockers 10 and 11 may extend with a slightly downward gradient towards the neck part 3.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush head with a bristle support to which a plurality of cleaning elements are affixed, the toothbrush head having a distal end remote from a handpiece side and a proximal end closer to the handpiece side than the distal end, the bristle support comprising:

a mounting section having a central support section; and at least a first rocker having a first end and a second end opposite to the first end, the first end being attached to the mounting section adjacent to the distal end, and the second end being a free end disposed adjacent to the proximal end, said rocker being movable relative to the handpiece such that during a movement of the rocker the free end thereof flexes away more intensely than the rest of the rocker, the rocker carrying a row of cleaning elements movable relative to the handpiece, each of said movable cleaning elements having a longitudinal axis and a free end, wherein the movable cleaning elements arranged on the at least a first rocker furthest from a longitudinal center plane of the toothbrush head have their free ends inwardly tilted towards said longitudinal center plane, wherein during the movement of the rocker the movable cleaning elements move sideways in a direction not parallel to their longitudinal axes, and the movable cleaning elements arranged on the free end of the rocker are deflected away more intensely than the movable cleaning elements arranged on the rocker intermediate its first and second ends.

2. The toothbrush head according to claim 1, further comprising a second rocker having a first end attached to the mounting section adjacent to the distal end and having a free second end disposed adjacent to the proximal end, said second rocker comprising at least one row of cleaning elements arranged symmetrically relative to the longitudinal center plane with respect to the cleaning elements arranged on the first rocker.

3. The toothbrush head according to claim 2 wherein the cleaning elements on the first rocker and second rocker are tilted inwardly towards the longitudinal center plane at different angles, wherein the cleaning elements arranged at a greater distance from the longitudinal center plane are more steeply tilted than cleaning elements arranged closer to the longitudinal center plane.

4. The toothbrush head according to claim 3, wherein all the cleaning elements spaced from the longitudinal center plane on the first and/or second rocker are arranged at an angle of tilt of from about 1 degrees to about 30 degrees.

5. The toothbrush head according to claim 3, wherein all the cleaning elements spaced from the longitudinal center plan on the first and/or second rocker are arranged at an angle of tilt of from about 5 degrees to about 20 degrees, relative to the longitudinal center plane.

6. The toothbrush head according to claim 2, wherein at least one of the first and second rockers comprises a free length L in the range of about 20 mm to about 70 mm and have a modulus of elasticity in the range of about 300 MPa to about 700 MPa.

7. The toothbrush head according to claim 2, wherein at least one of the first and second rockers comprises a free length L in the range of about 30 mm to 50 mm and have a modulus of elasticity in the range of about 350 MPa to about 500 MPa.

8. The toothbrush head according to claim 2, wherein at least one of the first and second rockers is made of a material different from a material of the toothbrush head's body part carrying the bristle support.

9. The toothbrush head according to claim 2, wherein at least one of the first and second rockers comprises a cleaning element disposed adjacent to its respective free end, said cleaning element having a larger area of cross-section than the cleaning elements affixed to the at least one of the first and second rockers outboard of the free end.

10. The toothbrush head according to claim 1 wherein the cleaning elements on the first rocker are tilted inwardly towards the longitudinal center plane at different angles, wherein the cleaning elements arranged at a greater distance from the longitudinal center plane are more steeply tilted than cleaning elements arranged closer to the longitudinal center plane.

11. The toothbrush head according to claim 2, wherein the bristle support includes a central section which lies between the first and second rockers and carries at least one row of cleaning elements arranged substantially parallel to the longitudinal center plane.

12. The toothbrush head according to claim 11, wherein the central section of the bristle support is rigidly connected to the toothbrush head.

13. The toothbrush according to claim 11, wherein at least one of the first and second rockers is made from a material different from a material of the central section.

14. The toothbrush head according to claim 2, wherein at least one of the first and second rockers comprises a cleaning element disposed adjacent to its respective free end, said cleaning element having a greater resistance to kinking than the cleaning elements affixed to the at least one of the first and second rockers outboard of the free end.

15. The toothbrush head according to claim 14, wherein the cleaning element affixed to the free end of the at least one of the first and second rockers has a greater height than the cleaning elements positioned closer to the respective first attached ends of the at least one of the first and second rockers.

16. A toothbrush head with a bristle support to which a plurality of cleaning elements are affixed, the toothbrush head having a distal end remote from a handpiece side and a proximal end closer to the handpiece side than the distal end, the bristle support comprising:

a mounting section having a central support section; and at least a first rocker having a first end elastically attached to the mounting section adjacent to the distal end and having a free second end disposed adjacent to the proximal end, said rocker being elastically movable relative to the handpiece for an elastic movement during use of the toothbrush, the rocker carrying a row of cleaning elements movable relative to the handpiece, each of the cleaning elements having a longitudinal axis and a free end, the cleaning elements comprising movable outmost cleaning elements arranged furthest from a longitudinal center plane of the toothbrush head, wherein said outmost cleaning elements have their free ends tilted in both a first direction and a second direction, the first direction being a direction towards the longitudinal center plane of the toothbrush head, and the second direction being a direction perpendicular to said first direction, wherein during the elastic movement of the rocker the movable outmost cleaning elements move sideways in a direction not parallel to their longitudinal axes, and wherein the movable outmost cleaning elements affixed to the free end of the rocker are deflected away more intensely than the movable cleaning elements affixed to the rocker intermediate the first and second ends thereof and have a greater resistance to kinking than the cleaning elements affixed to the rocker intermediate the first and second ends thereof.

17. The toothbrush head of claim 16, wherein the movable outmost cleaning elements located on the free end of the rocker are selected from the group consisting of cleaning elements having a cross section that is larger than a cross section of the cleaning elements affixed to the rocker intermediate its first and free ends and cleaning elements having a height that is greater than a height of the cleaning elements affixed to the rocker intermediate its first and free ends.

* * * * *